US010292441B2

(12) United States Patent
Graves

(10) Patent No.: US 10,292,441 B2
(45) Date of Patent: May 21, 2019

(54) CONFIGURABLE GARMENT AND METHOD THEREOF

(71) Applicant: Sherry Graves, Albany, NY (US)

(72) Inventor: Sherry Graves, Albany, NY (US)

( * ) Notice: Subject to any disclaimer, the term of this patent is extended or adjusted under 35 U.S.C. 154(b) by 357 days.

(21) Appl. No.: 14/602,956

(22) Filed: Jan. 22, 2015

(65) Prior Publication Data

US 2015/0201687 A1 Jul. 23, 2015

Related U.S. Application Data

(60) Provisional application No. 61/930,676, filed on Jan. 23, 2014.

(51) Int. Cl.
*A41D 23/00* (2006.01)

(52) U.S. Cl.
CPC ..... *A41D 23/00* (2013.01); *A41D 2023/004* (2013.01)

(58) Field of Classification Search
CPC ..... A42B 5/00; A41D 2023/002; A41D 2023/004; A41D 2023/006; A41D 23/00
USPC ..... 2/206, 207, 209.11
See application file for complete search history.

(56) References Cited

U.S. PATENT DOCUMENTS 366,788 A * 7/1887 Nehemias ..... A41D 13/11 2/206
1,316,778 A * 9/1919 Ensten ..... A42B 1/045 2/172
1,399,523 A * 12/1921 Sable ..... A41D 23/00 2/203
1,431,287 A * 10/1922 Cohn ..... A42B 1/066 2/172
1,590,322 A * 6/1926 Schlesinger ..... A42B 1/066 2/172
1,686,258 A * 10/1928 Schlesinger ..... A42B 1/066 2/172
1,720,560 A * 7/1929 Lipper ..... A42B 1/041 2/171
D92,603 S * 6/1934 James ..... 2/171
2,039,478 A * 5/1936 Ensten ..... A42B 1/045 2/203
2,130,933 A * 9/1938 Sweet ..... A41D 23/00 2/203
2,413,319 A * 12/1946 Golfieri ..... A41D 23/00 2/171.01
2,420,378 A * 5/1947 Lehman ..... A42B 1/045 2/195.8
2,806,222 A * 9/1957 Carpenter ..... A41D 1/22 2/207
3,286,276 A * 11/1966 Calisch ..... A41D 23/00 2/207
3,307,202 A * 3/1967 Schuessler ..... A42B 1/066 2/173

(Continued)

*Primary Examiner* — Gloria M Hale
(74) *Attorney, Agent, or Firm* — Schmeiser, Olsen & Watts, LLP

(57) ABSTRACT

A configurable garment capable of being worn in a plurality of positions on a user, one of the plurality of positions including a combination of a scarf and a headband, wherein the configurable garment is formed from a unitary body section of material that includes at least two closed loop sections coupled together by a connection, the connection including at least one seam, is provided. An associated method is also provided.

8 Claims, 7 Drawing Sheets

(56) References Cited

U.S. PATENT DOCUMENTS 3,340,542 A * 9/1967 Greenwald ..... A42B 1/066 2/172
4,723,325 A * 2/1988 Perry ..... A41D 20/00 2/181
5,081,714 A * 1/1992 Liu ..... B60R 22/001 2/308
5,539,933 A * 7/1996 Garber ..... A41F 9/002 2/311
5,651,143 A * 7/1997 Zehrung ..... A47D 13/025 2/16
5,765,230 A * 6/1998 Sivret ..... A42B 1/046 2/202
5,822,800 A * 10/1998 Anderson ..... A42B 1/041 2/171
5,867,835 A * 2/1999 Dabbieri ..... A42C 5/00 2/171
6,145,131 A * 11/2000 Huff ..... A41D 23/00 2/171
6,185,749 B1 * 2/2001 Williams ..... A41D 23/00 2/171
6,226,799 B1 * 5/2001 Lane ..... A41D 23/00 2/207
6,442,763 B1 * 9/2002 Larson ..... A42B 1/046 2/171
6,701,532 B1 * 3/2004 Glassberg ..... A41D 20/00 2/170
6,996,855 B1 * 2/2006 Dandrea ..... A41F 9/002 2/338
D518,625 S * 4/2006 Barnhouse ..... D2/866
D529,682 S * 10/2006 Strong ..... D2/501
D627,130 S * 11/2010 Postulart ..... D2/500
D695,995 S * 12/2013 Kim ..... D2/500
9,138,025 B1 * 9/2015 Lunsford ..... A42B 1/041
2004/0181851 A1 * 9/2004 Kanitz ..... A41D 23/00 2/259
2004/0210984 A1 * 10/2004 Cohen ..... A41D 15/00 2/171
2006/0130213 A1 * 6/2006 Mickle ..... A42B 1/046 2/202
2006/0143796 A1 * 7/2006 Bugarin ..... A41D 23/00 2/202
2009/0000011 A1 * 1/2009 Halley ..... A42B 5/00 2/207
2009/0145455 A1 * 6/2009 Saponaro ..... A45D 8/00 132/275
2010/0064418 A1 * 3/2010 Graham ..... A45D 8/34 2/206
2010/0107301 A1 * 5/2010 Gallo ..... A41D 23/00 2/91
2010/0186145 A1 * 7/2010 Macy ..... A42B 1/061 2/207
2010/0229283 A1 * 9/2010 Diaz ..... A41D 23/00 2/207
2011/0185482 A1 * 8/2011 Godfrey ..... A41D 13/1161 2/424
2011/0209266 A1 * 9/2011 Perry ..... A41D 23/00 2/207
2012/0023639 A1 * 2/2012 Rojas Mas ..... A42B 1/048 2/84
2012/0054944 A1 * 3/2012 Bonner ..... A42B 1/066 2/207
2012/0204323 A1 * 8/2012 Park ..... A41D 23/00 2/202
2012/0291181 A1 * 11/2012 Absi ..... A42B 1/041 2/207
2012/0324624 A1 * 12/2012 Day ..... A41D 23/00 2/202
2013/0326792 A1 * 12/2013 Matos ..... A41D 23/00 2/207
2014/0109293 A1 * 4/2014 Ramadan ..... A41D 23/00 2/207
2015/0181959 A1 * 7/2015 Hendricks ..... A41B 15/00 2/207
2015/0201687 A1 * 7/2015 Graves ..... A41D 23/00 2/207
2016/0128398 A1 * 5/2016 Fallon ..... A41D 13/11 2/206
2016/0374415 A1 * 12/2016 Chang ..... A41D 15/00 2/69

* cited by examiner

CONFIGURABLE GARMENT AND METHOD THEREOF

CROSS-REFERENCE TO RELATED APPLICATIONS

This application claims priority to and the benefit of U.S. Provisional Application No. 61/930,676, filed Jan. 23, 2014, entitled "Configurable Garment."

FIELD OF TECHNOLOGY

The following relates to a configurable garment, and more specifically to embodiments of a one-piece garment that can be a scarf, a headband, or both.

BACKGROUND

Scarves and headbands are worn for warmth. However, they may also be fashionable. Some prefer scarves over headbands, and vice versa. Others enjoy wearing both, but must decide which one to wear, or carry both around if a switch is desired, or dictated by weather. Furthermore, the scarf has a drawback in that it does not provide warmth or cover for the ears and head. Likewise, the headband has a drawback in that it leaves the neck area exposed. In each case, an area of the body is not covered when wearing one or the other.

Thus, a need exists for an apparatus and method for a configurable garment that can be both a scarf and a headband, and can also be a combination of a scarf and a headband.

SUMMARY

A first aspect relates generally to an apparatus comprising a configurable garment capable of being worn in a plurality of positions on a user, one of the plurality of positions including a combination of a scarf and a headband, wherein the configurable garment is formed from a unitary body section of material that includes at least two closed loop sections coupled together by a connection, the connection including at least one seam.

A second aspect relates to a configurable garment comprising a unitary body section having a first end, a second end, a length, a width, a first side, and a second side, the unitary body being manipulated to form a first loop section and a second loop section, wherein the first loop section is formed by folding a first section of the unitary body proximate the first end of the unitary body towards the second end creating a first seam to attach the first section to the first side of the unitary body, and the second loop section is formed by folding a second section of the unitary body proximate the second end of the unitary body towards the first seam creating a second seam to attach the second section to the second side of the unitary body, and a connection formed by the combination of the first seam and the second seam, the connection coupling the first loop section and the second loop section, wherein the first loop section and the second loop section move with respect to each other to accommodate a plurality of wearable positions on a user.

A third aspect relates to a method comprising providing a unitary body section having a first end, a second end, a length, a width, a first side, and a second side, manipulating a first section of the unitary body section proximate the first end of the unitary body section by moving the first section towards the second end of the unitary body section a distance, wherein a face of the first section of the unitary body section touches the first side of another part of the unitary body section proximate an edge of the first section, attaching the first section proximate the edge of the first section to the first side of the unitary body section to create a first seamed connection, manipulating a second section of the unitary body section proximate the second end of the unitary body section by moving the second section towards the first seamed connection, wherein a face of the second section of the unitary body section touches the second side of another part of the unitary body section proximate an edge of the second section, and attaching the second section proximate the edge of the second section to the second side of the unitary body section to create a second seamed connection, wherein the first seamed connection and the second seamed connection combine to form a connection, the connection coupling a first loop section and a second loop section, wherein the first loop section and the second loop section are moved with respect to other to accommodate a plurality of wearable positions on a user.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
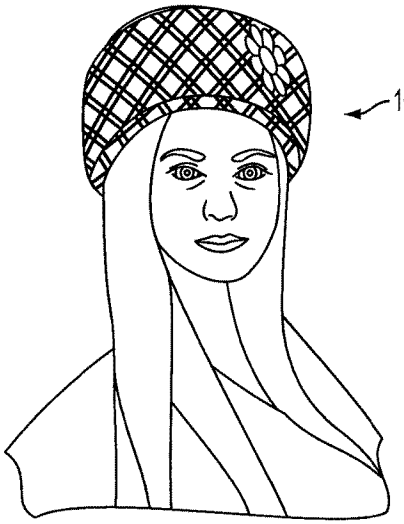
FIG. 1A depicts a perspective view of an embodiment of a configurable garment worn as a headband, wherein the configurable garment is worn in a first position.
Figure 1B:
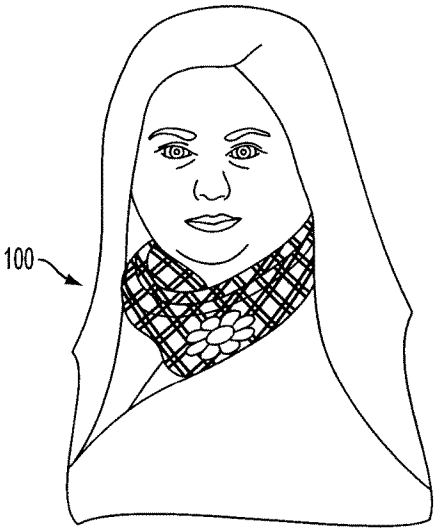
FIG. 1B depicts a perspective view of an embodiment of the configurable garment worn as a scarf, wherein the configurable garment is worn in a second position.
Figure 1C:
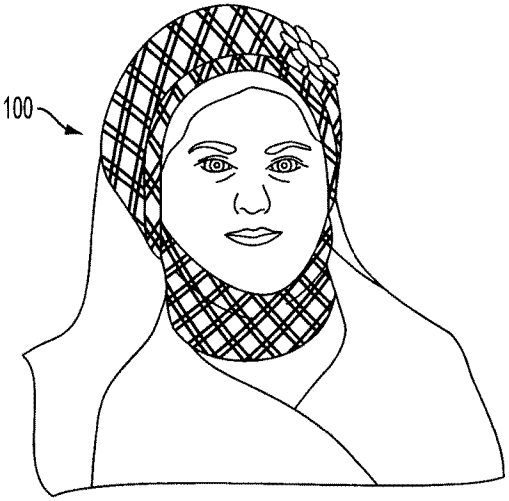
FIG. 1C depicts a perspective view of an embodiment of the configurable garment worn as a combination of a scarf and a headband, wherein the configurable garment is worn in a third position.
Figure 1D:
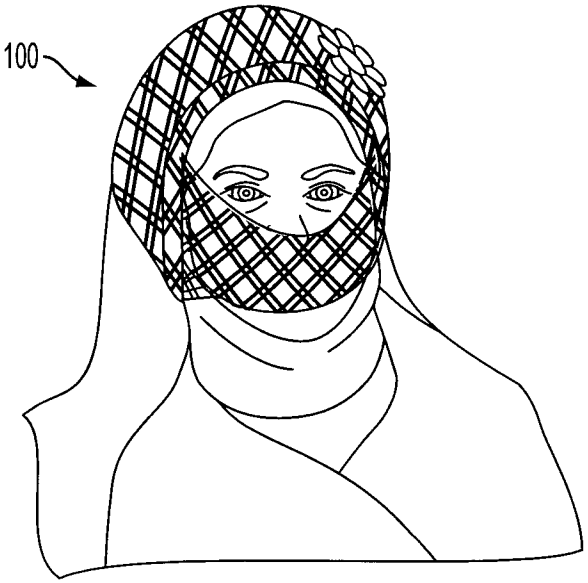
FIG. 1D depicts a perspective view of an embodiment of the configurable garment worn over the nose and mouth, wherein the configurable garment is worn in a fourth position.

Referring to the drawings, FIGS. 1A-1C depict an embodiment of a configurable garment 100, configured to be worn in a plurality of positions. FIG. 1A depicts an embodiment of the configurable garment 100 being worn in a first position. Embodiments of the first position may be around a head of a user, covering the ears of the user. For instance, the first position may be similar to a position a headband may be worn. In the first position, the ears of the user may be covered, and a neck area of the user may be exposed. The garment 100 may be in a circular or other curvilinear shape, wherein the garment 100 may be twice its thickness. FIG. 1B depicts an embodiment of the configurable garment 100 being worn in a second position. Embodiments of the second position may be around a neck area of the user, covering the neck area of the user. For instance, the second position may be similar to a position a scarf may be worn. In the second position, the neck area of the user may be covered, and the ears of the user may be exposed. The garment 100 may be in a circular or other curvilinear shape, wherein the garment 100 may be twice its thickness. FIG. 1C depicts an embodiment of the configurable garment 100 being worn in a third position. Embodiments of the third position may be around a head of a user, covering the ears of the user, and may also be around the neck area of the user. For instance, the third position may be a combination of the first position and the second position. In the third position, the ears of the user may be covered, and a neck area of the user may be covered. FIG. 1D depicts an embodiment of the configurable garment 100 being worn in a fourth position. Embodiments of the fourth position may be around a head of a user, covering the ears of the user, and may also be around the nose and mouth area of the user. For instance, the fourth position may utilize the first position of the garment 100 while covering the nose and mouth area of the user. In the fourth position, the ears of the user may be covered, and a nose and mouth area of the user may be covered. Further embodiments include a garment 100 configured to be worn in a position where the neck area is covered and the nose and mouth area are also covered. The configurable garment 100, and a first and second loop section 30, 40 thereof, may be moveable with respect to each other to achieve the plurality of wearable position. Further, each of the plurality of positions may be achieved by moving the components of the garment 100 without removing the garment 100 from the user's head. For example, the user may be able to change from a scarf-wearing position to a combination scarf/headband position without taking the garment 100 off the user's head, or even removing at least one of the loops 30, 40 from the neck. All of the plurality of positions may be achieved by manipulating or otherwise moving the garment 100 and the loops 30, 40 thereof without removing the garment 100.

Embodiments of the configurable garment 100 may be a clothing item, an article of clothing, an accessory, a fashion accessory, a headware, a neckware, outerwear, a wearable material, an adjustable garment, and the like. Embodiments of the configurable garment 100 may be made of a fabric, a knitting material, a mesh material, nylon, cotton, polyester, leather, wool, silk, fur, cashmere, down filled material, denim, synthetic materials, and the like, and combinations thereof. Moreover, embodiments of the configurable garment 100 may be expandable, pliable, flexible, conformal, stretchable, breathable, and the like. The degree in which the garment 100 may be expandable, pliable, etc., may depend on the material(s) comprising the garment 100. Embodiments of the configurable garment 100 may be designed in various colors, having a single or multiple colors, and may include various patterns. Objects, such as fashion accessories, hairpins, pins, emblems, and jewelry pieces may be affixed to the configurable garment 100.

Figure 2:
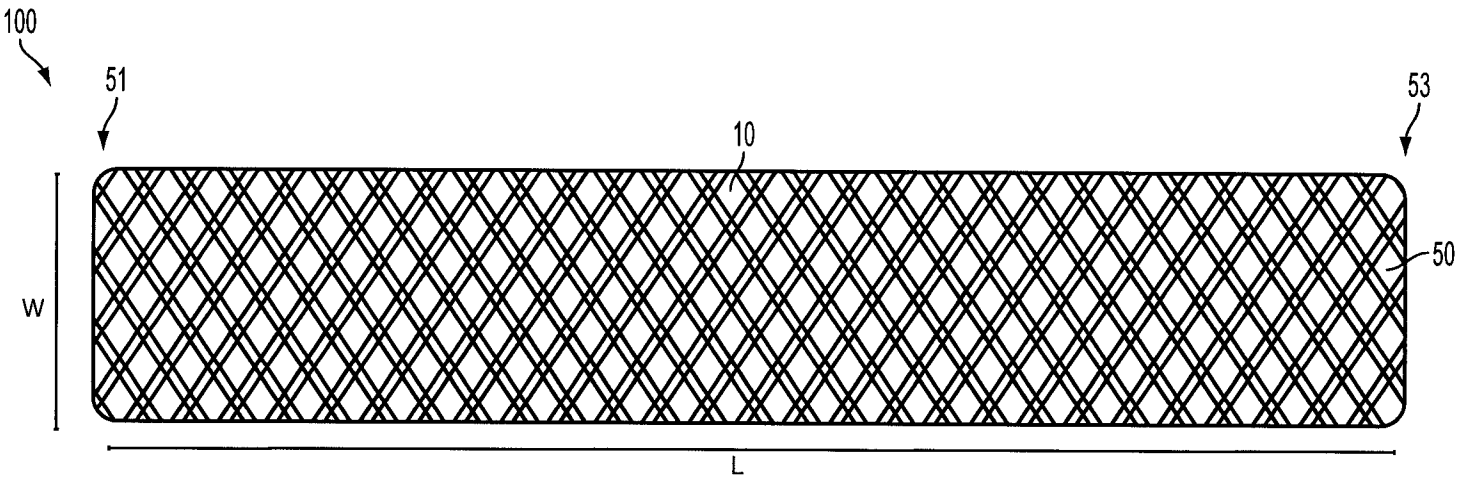
FIG. 2 depicts a front view of an embodiment of a unitary body of the configurable garment.

Referring now to FIG. 2, embodiments of the configurable garment 100 may include a body 50. Embodiments of the body 50 may be a body section, a body portion, a section, an original piece, and the like. Embodiments of the body 50 may be a unitary or uniform body. For example, embodiments of the body 50 may a one-piece unit or section of material comprising the configurable garment 100. In alternative embodiment, the body 50 may include a plurality of sections of material that can be affixed, sewn, glued, intertwined, or otherwise connected together to form a single body or single section of material. Moreover, embodiments of the body 50 may have a first end 51, a second end 53, a first side 10, and a second side 20 (shown in FIG. 4). The first and second sides 10, 20 may be opposing or opposite sides of the body 50. The sides 10, 20 may be comprised of the same material, yet have different colors or patterns. For example, the first side 10 may have a first decorative design while the second side 20 may have the same or different decorative design, so that when the garment 100 is worn, the different sides 10, 20 may be utilized to accomplish various looks. Embodiments of the body 50 may begin as a substantially flat section of material having a thickness, wherein the body portion 50 may have a generally rectangular shape with a rectangular or square cross-section. The cross-section of the body portion 50 may vary depending on the shape and design of the body 50. The thickness of the body 50 may depend on the desired design of the garment 100. In addition, a length, L, of the body 50 may vary depending on the desired design of the garment 100; the length, L, of the body 50 may be the distance between the first end 51 and the second end 53 of the body. In one embodiment, the length, L, of the body 50 may be between 10 and 36 inches. Similarly, a width, w, of the body 50 may vary depending on the desired design of the garment. In one embodiment, the width, w, of the body 50 may be between 1-10 inches. However, those skilled in the art should appreciate that various dimensions may apply depending on a size of the wearer and/or the vision of the designer/creator. Embodiments of the wearer may be living or non-living, which may be a human being, a toy, a doll, a pet, a model, a mannequin, and the like.

Figure 3:
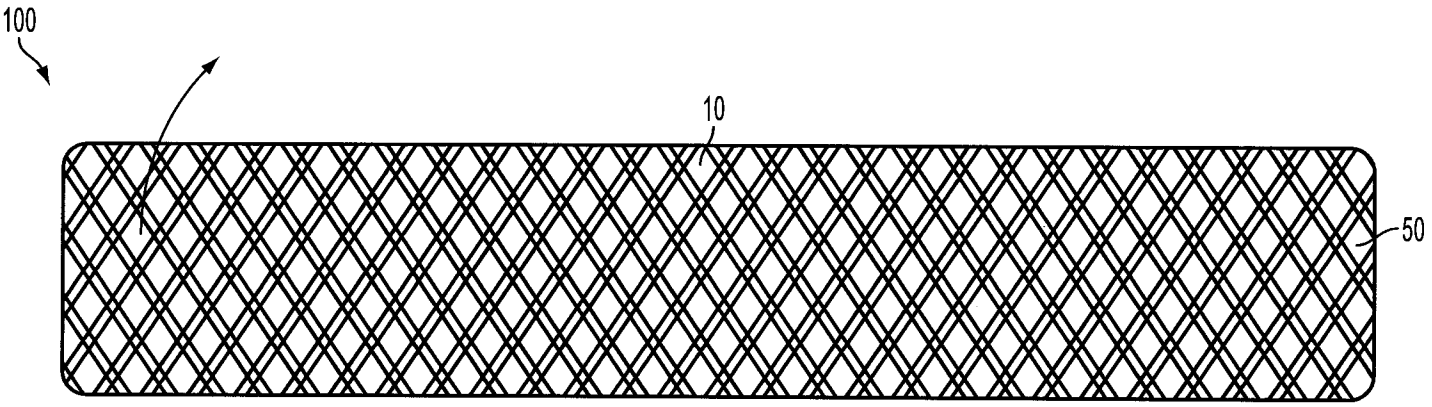
FIG. 3 depicts a front view of an embodiment of the unitary body, with an arrow indicating a next fold of the body.

Embodiments of the body 50 may be manipulated, configured, and/or worked into an embodiment of the configurable garment 100, such that the configurable garment 100 may be worn in multiple positions, as shown in FIG. 3-6. FIG. 3 shows an arrow that indicates a direction that a part of the material of the garment 100 may initially be moved to effectuate a first fold that results in a first seam 60. This initial movement may also originate from the first end 51, or may originate from the opposing, second end 53 of the body 50. For instance, a first section 52 of the body 50 may be folded over towards the other end of the body 50, wherein the first side 10 of the folded section of the body 50 may touch or face the first side 10 of another part of the body 50 proximate an end or edge of the first section 52. The first section 52 of the body 50 may be folded over onto the first side 10 of the body 50 a distance. The distance the first section 52 is folded over may be between one-quarter and one-half of the entire length of the body 50. In one embodiment, the distance the first section 52 may be folded over may be slightly less than one-half of the entire length of the body 50. The distance the first section 52 is folded over may determine a size, circumference, radius, and/or diameter of a first loop section 30 or a second loop section 40, shown in FIG. 7.

Figure 4:
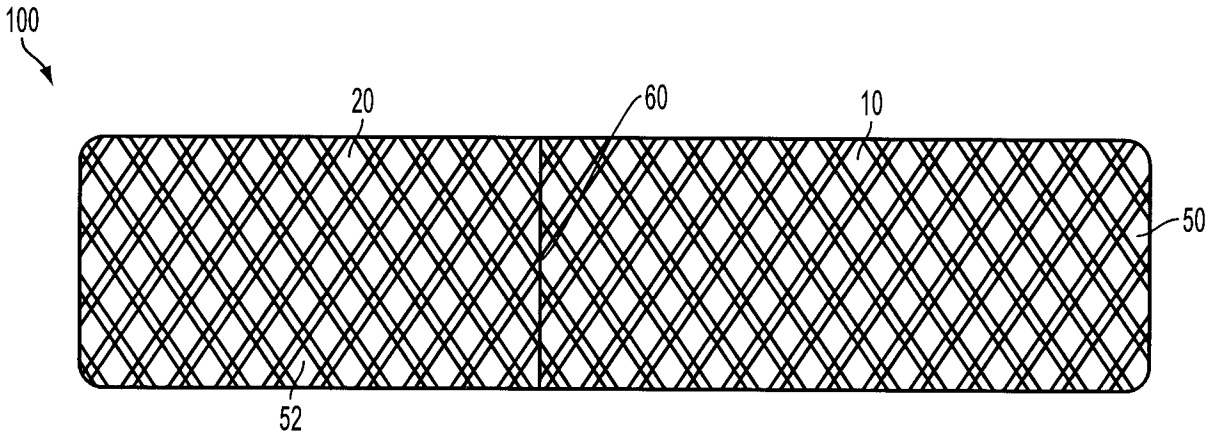
FIG. 4 depicts a front view of an embodiment of the body after being folded over to create a first seam.

Once the first section 52 is folded over the body 50 a desired distance, a first seam 60 may be created, formed, established, effectuated, etc. at that location (e.g. across or partially across the width, w, of the body on the first side 10), as depicted in FIG. 4. Embodiments of the first seam 60 may be a seam, a joint, a connection, and the like, to affix, attach, fasten, or otherwise join the first section 52 of the body 50 to the rest of the body 50. In an exemplary embodiment, the material may be sewn together to form the first seam 60. The first seam 60 may permanently affix the first foldable section 52 at a location on the first side 10 of the body 50. Embodiments of the first seam 60 may be a continuous seam along the width, w, of the body 50, or may be a plurality seams along the width, w, of the body 50. When the foldable first section 52 is attached or affixed to the body 50, a first loop 30 may be formed, wherein there is an opening, a space, a gap, or void between the sections of the body 50.

Figure 5:
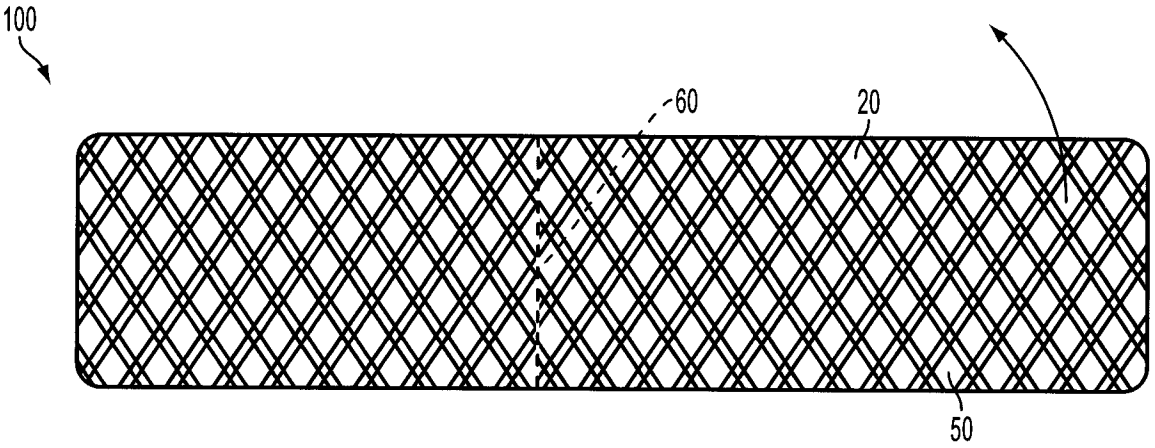
FIG. 5 depicts a rear view of an embodiment of the body, with an arrow indicating a next fold of the body.
Figure 6:
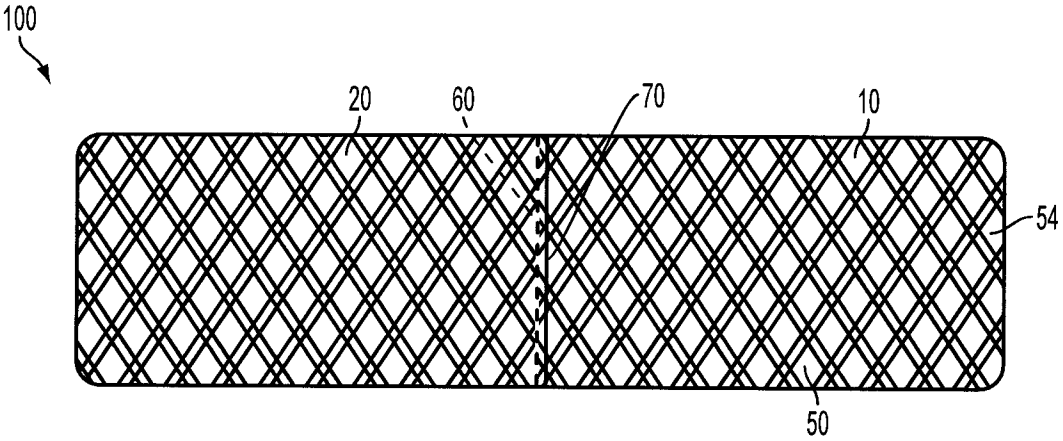
FIG. 6 depicts a rear view of an embodiment of the body after being folded over to create a second seam.

With reference to FIG. 5, after the first seam 60 is created, a second seam 70 may be created, formed, established, effectuated, etc. at location on the second side 20, across or partially across the width, w, of the body on the second side to create a second loop 40 of the configurable garment 100. For instance, the body 50 may be flipped over so that a second section 54 may be folded onto the second side 20, or opposite side of the first side 10, of the body 50. Those having skill in the art should appreciate that the second fold may be accomplished without flipping the body 50 over. An arrow depicts a direction of which a second section 54 or part of the material of the garment 100 may be moved to effectuate a second fold to create a second seam 70. This movement may also originate from the first end 51, or may originate from the opposing, second end 53 of the body 50, depending on the manner in which the initial fold and seam were accomplished. For instance, a second section 54 of the body 50 may be folded over towards the other/opposite end of the body 50, wherein the second side 20 of the folded section 54 of the body 50 may touch or face the second side 20 of another part of the body 50 proximate the an end or edge of the second section 54. The second section 54 of the body 50 may be folded over onto the second side 20 of the body 50 a distance. The distance the second section 54 is folded over may be between one-quarter and one-half of the entire length of the body 50. In one embodiment, the distance the first section 52 may be folded over may be slightly less than one-half of the entire length of the body 50. In another embodiment, the distance the second section 54 is folded over may be determined by the location of the first seam 60, wherein an end of the second folded section 54 resides at, proximate, or otherwise near the first seam 60. The distance the second section 54 is folded over may determine a size, circumference, radius, and/or diameter of a second loop section 40 (or a first loop section 30), shown in FIG. 7. When the foldable second section 54 is attached or affixed to the body 50, a second loop 40 may be formed, wherein there is an opening, a space, a gap, or void between the sections of the body 50.

Figure 7:
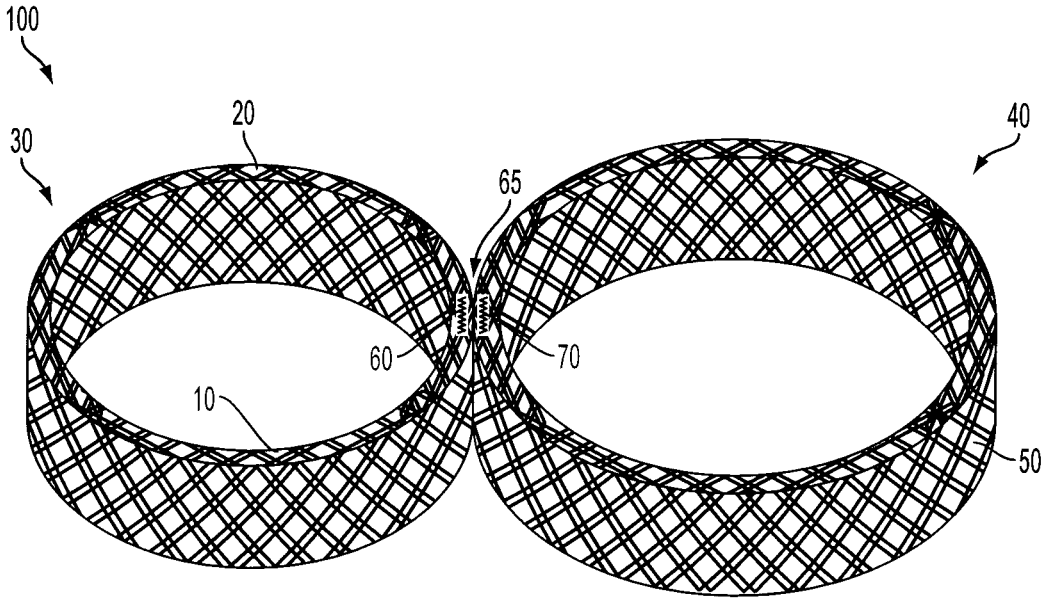
FIG. 7 depicts a top view of an embodiment of the configurable garment, after the first and second seams have been created.

FIG. 7 depicts a top view of an embodiment of the configurable garment 100 after the body 50 has been manipulated as described above. Embodiments of the configurable garment 100 may include a first loop section 30, a second loop section 40, and a connection 65. Embodiments of the first loop section 30 and the second loop section 40 may be circular or elliptical, and may be the same size, smaller, or larger than each other. The loop sections 30, 40 may be closed loop sections formed by the seam connections of the unitary body 50. In an embodiment where the body is 34 inches in a total length, the loop section configured to worn around the neck may comprise 16 inches; the neck loop section may be between 35%-50% of the total length of the body 50. The first loop section 30 and the second loop section 40 may be connected by the connection 65. The first loop section 30 and the second loop section 40 may be sized and dimensioned to fit on or around a human's head. Specifically, the opening or space within each of the first and second loop section 30, 40 may receive, accommodate, or accept a head of the user. In some embodiments, the loop sections 30, 40 may snugly fit over a head and/or a neck area of the user, wherein the loop sections 30, 40 may expand to resiliently conform to a head or neck area of the user. Embodiments of the connection 65 may be a seam, a seamed connection, a joint, and the like. For example, the first seam 60 and the second seam 70 may combine to form the connection 65. The connection 65 may comprise one or two sewn seams that couple the first loop section 30 and the second loop section 40. Embodiments of the connection 65 may be flexible such that the loops 30, 40 can move, pivot, hinge, rotate, and the like, with respect to each other to position the garment 100 in multiple positions.

Figure 8:
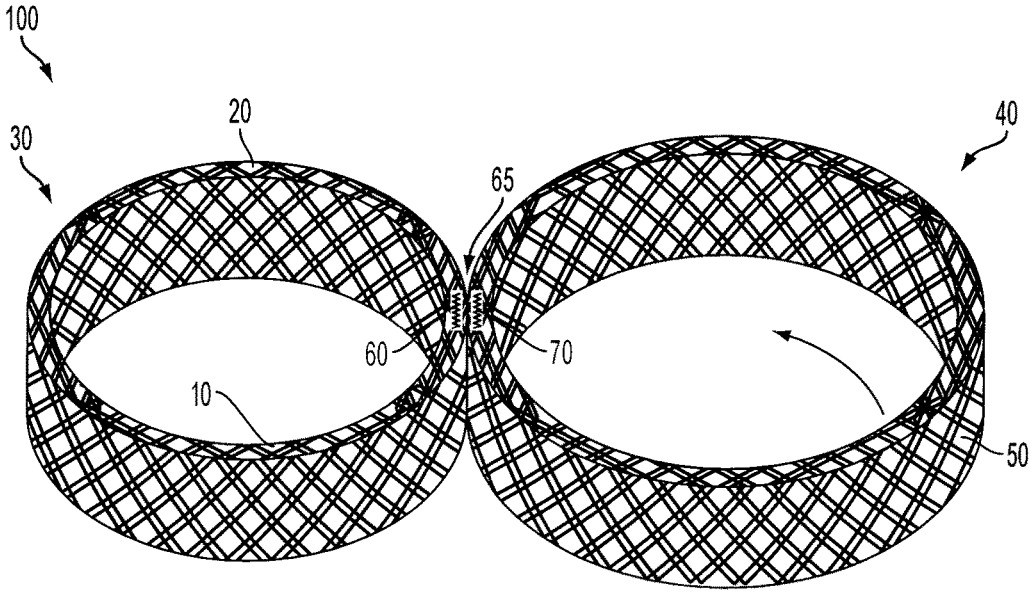
FIG. 8 depicts a top view of an embodiment of the configurable garment, with an arrow indicating a next fold to achieve a first wearable position.
Figure 9:
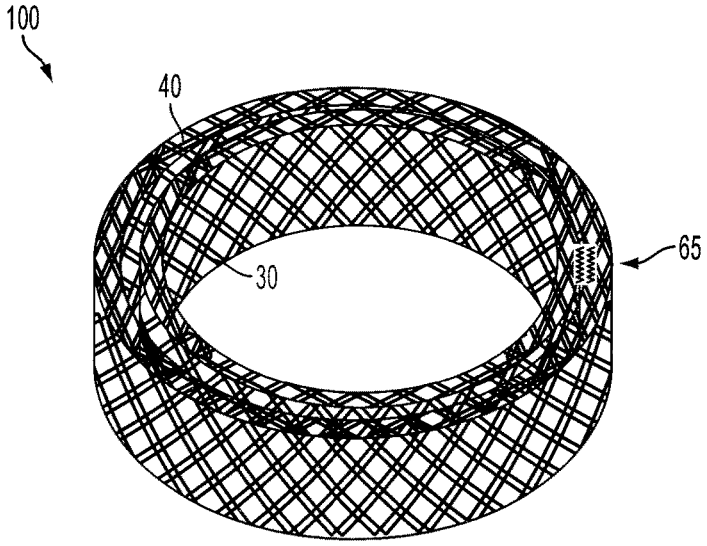
FIG. 9 depicts a top view of an embodiment of the configurable garment in the first wearable position.

Referring now to FIGS. 8 and 9, the configurable garment 100 may be configured, manipulated, moved, switched etc., to a first wearable position, as depicted in FIG. 9. An arrow depicted in FIG. 8 shows a direction that the second loop section 40 may be folded to achieve the first wearable position. For example, the second loop 40 may be folded over towards the first loop section 30 to achieve the first wearable position. Alternatively, the first loop section 30 may be folded towards the second loop section 40 to achieve the first wearable position. Embodiments of the first wearable position may be achieved when the second loop section 40 is folded within or around or outside the first loop section 30, and vice versa. Because the material comprising the configurable garment 100 may be expandable, the loops 30, 40 may fit within one another, regardless of their size. When in the first wearable position, the user may wear the garment 100 in the first or second position, as depicted in FIGS. 1A and 1B. In other words, when the garment 100 is in the first wearable position, the user may wear the garment 100 as a scarf (e.g. covering a neck area of the user) or a headband (e.g. covering the ears and/or part of the head of the user). The garment 100 may also be worn loose, wherein no expansion of the garment 100 from its original state takes places when in any of the wearable positions.

Furthermore, embodiments of the configurable garment 100 may be manipulated, changed, moved, switched etc. to a second wearable position, as depicted in FIGS. 1C and 1D. Because the body 50 is a unitary body folded and sewn/fastened in the manner described above, and includes a flexible connection 65, the garment 100 may conveniently transition from a scarf or headband to a combination thereof. For instance, a user may separate the second loop 40 from the first loop 30 (or vice versa) in a jaw-like or clamshell motion so that the second loop 40 (or first loop 30) may cover a portion of the head and ears of the user, while the first loop 30 (or second loop 40) may cover a neck area of the user. In other embodiment, the loop sections 30, 40 may be separated at various distances to achieve various wearing configurations; the loop sections 30, 40 do not need to cover both the ears/head and neck in the second wearable position. Changing from the first wearable position to the second wearable position may be accomplished while the garment 100 is being worn by the user. Accordingly, the garment 100 may be configured in two wearable configurations, and may be worn in at least four positions. Those having skill in the art should appreciate that the garment 100, although described as being worn proximate a user's head, may be configured to be worn at other locations on the body.

Referring to FIGS. 1-9, a method of forming the configurable garment 100 may include the steps of providing a unitary body section 50 having a first end 51 and a second end 53, folding a first portion 52 of the body 50 proximate the first end 51 towards the second end 53 of the body 50a onto a first side 10 of the body 50, creating a first seam 60 at a location on the body 50 where the first portion 52 contacts the body 50 after being folded over, folding a second portion 54 of the body 50 proximate the second end 53 towards the first end 51 of the body onto a second side 20 of the body 50, and creating a second seam 70 at a location on the body 50 where the second portion 54 contacts the body 50 after being folded over. The resultant garment 100 formed by this method may be configured into two or more wearable configurations, and may be worn by the user in at least four positions. Embodiments of a method may further include providing a unitary body section 50 having a first end 51, a second end 53, a length, L, a width, w, a first side 10, and a second side 20, manipulating a first section 52 of the body section 50 proximate the first end 51 of the unitary body 50 by moving the first section 51 towards the second end 53 of the unitary body 50a distance, wherein a face of the first section 52 of the body 50 touches the first side 10 of another part of the unitary body 50 proximate an edge of the first section 52, attaching the first section 52 proximate the edge of the first section 52 to the first side 10 of the unitary body 50 to create a first seamed connection 60, manipulating a second section 54 of the body section 50 proximate the second end 53 of the unitary body 50 by moving the second section 54 towards the first seamed connection 60, wherein a face of the second section 54 of the body 50 touches the second side 20 of another part of the unitary body 50 proximate an edge of the second section 54, and attaching the second section 54 proximate the edge of the second section 54 to the second side 20 of the unitary body 50 to create a second seamed connection 70. The first seamed connection 60 and the second seamed connection 70 may combine to form a connection 65, the connection 65 coupling a first loop section 30 and a second loop section 40, wherein the first loop section 30 and the second loop section 40 can be moved with respect to other to accommodate a plurality of wearable positions on a user.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

The claims are as follows:

1. A method of making a configurable head and neck worn garment, the method comprising:

providing a single elongated linear strip of material having a first end, a second end, a length, a width, a first side, and a second side;

folding a first section of the single elongated linear strip of material originating at the first end of the single elongated linear strip of material towards the second end of the single elongated linear strip of material;

after folding the first section, attaching the first section to the first side of the single elongated linear strip of material to create a first seamed connection transverse to the length of the single elongated linear strip of material;

folding a second section of the single elongated linear strip of material originating at the second end of the single elongated linear strip of material towards the first seamed connection; and after folding the second section, attaching the second section to the second side of the single elongated linear strip of material to create a second seamed connection transverse to the length of the single elongated linear strip of material, wherein the first seamed connection is adjacent to the second seamed connection;

wherein the first seamed connection and the second seamed connection combine to form a connection, the connection coupling a first loop section and a second loop section, the first loop section and the second loop section being formed from the single strip of linear material, wherein the first loop section and the second loop section are moved with respect to each other to accommodate a plurality of wearable positions on a user.

2. The method of claim 1, wherein, a first wearable position of the plurality of wearable positions, the first loop section and the second loop section are both worn around the user's head.

3. The method of claim 1, wherein, in a second wearable position of the plurality of wearable positions, the first loop section and the second loop section are both worn around the user's neck.

4. The method of claim 1, wherein, in a third wearable position of the plurality of wearable positions, the first loop section is worn around the user's head and the second loop section is worn around the user's neck.

5. The method of claim 1, wherein, in a fourth wearable position of the plurality of wearable positions, the first loop section is worn around the user's head and the second loop section is worn around the user's nose and mouth.

6. The method of claim 1, wherein the single elongated linear strip of material is comprised of an expandable material.

7. The method of claim 1, wherein the first loop section is smaller than the second loop section such that the first loop section fits within the second loop section.

8. The method of claim 1, wherein the first loop section and the section loop section move with respect to each other to achieve the plurality of wearable positions without removing the single elongated linear strip of material from the user's head.

* * * * *